United States Patent [19]

Jacoby

[11] 4,159,705

[45] Jul. 3, 1979

[54] TOY PROJECTILE LAUNCHING DEVICE

[76] Inventor: Ian H. Jacoby, Rd. 1, Mt. Hope Rd., Middletown, N.Y. 10940

[21] Appl. No.: 874,856

[22] Filed: Feb. 3, 1978

[51] Int. Cl.[2] ..... A63H 33/18; F41F 1/04

[52] U.S. Cl. ..... 124/63; 124/70; 124/75; 46/44

[58] Field of Search ..... 124/61, 62, 63, 64, 124/65, 69, 70, 71, 73, 75; 46/44, 74 B, 81, 87, 88, 90

[56] References Cited

U.S. PATENT DOCUMENTS

| | | | |
|---|---|---|---|
| 1,405,664 | 2/1922 | Boileau | 124/75 |
| 1,486,215 | 3/1924 | Zerbee | 124/69 |
| 3,739,764 | 6/1973 | Allport | 124/70 |

*Primary Examiner*—Richard T. Stouffer

*Attorney, Agent, or Firm*—Mark T. Basseches; Paula T. Basseches

[57] ABSTRACT

The present invention relates to a pneumatic toy projectile launching device including a launching barrel, a reservoir for air under pressure, a pump inflation member and a flexible conduit joining the pump to the body of the device. The single conduit is employed both to fill the reservoir and for triggering launching of the projectile.

7 Claims, 5 Drawing Figures

2
2
10
11
12
13
14
15
16
17
17
28
30
32
38
40
41

10
13
14
15
16
21
22
23
24
25
25'
26
27
28
29
30
31
32
33
34
35
36
37
38
39
40
41
42
43
44
45
46
47
48

TOY PROJECTILE LAUNCHING DEVICE

BACKGROUND OF THE INVENTION

1. Field of the Invention

The present invention is in the field of toy cannon or projectile launchers.

2. The Prior Art

Numerous toy cannon or pop gun type devices are known wherein energy developed, as through pumping a reservoir, cranking a lever, etc., is stored. The stored energy may be released to launch a projectile by mechanically tripping a trigger mechanism forming a part of the housing containing the reservoir and barrel assembly.

SUMMARY OF THE INVENTION

The present invention may be summarized as directed to an improved toy cannon or projectile launcher which is of simple design and operation, has a high degree of accuracy and low cost of manufacture. The device includes a housing having a barrel for launching and guiding a projectile, a pneumatic storage reservoir for collecting air under pressure, a pump capable of developing super-atmospheric pressure, a conduit connecting the pump to the housing, and a pilot valve assembly adapted selectively to connect the pump to the reservoir or to connect the reservoir to a chamber behind the barrel for launching of a projectile. The device is characterized by the use of a pump mechanism which is capable both of charging the reservoir and of shifting the pilot valve assembly to induce the launching of a projectile in accordance with the pressures in the conduit connecting the pump to the housing.

By thus interposing a flexible conduit between the pump and the housing, the requirement for activating a trigger mechanically connected to the housing, with the inherent resultant aiming inaccuracies, is eliminated.

It is accordingly an object of the invention to provide a toy cannon device which is safe, inexpensive and accurate.

A further object of the invention is the provision of a device of the type described which is remotely operable through manipulation of a pump mechanism connected thereto via a flexible conduit, the pump mechanism functioning through the conduit both to charge an air reservoir connected to the barrel and to trigger release of the stored pneumatic energy behind the projectile and effect its launching.

Still a further object of the invention is the provision of a device of the type described which is extremely accurate by virtue of the absence of any mechanical triggering devices on the barrel.

To attain these objects and such further objects as may appear herein or be hereinafter pointed out, reference is made to the accompanying drawings, forming a part hereof, in which.

Figure 1:
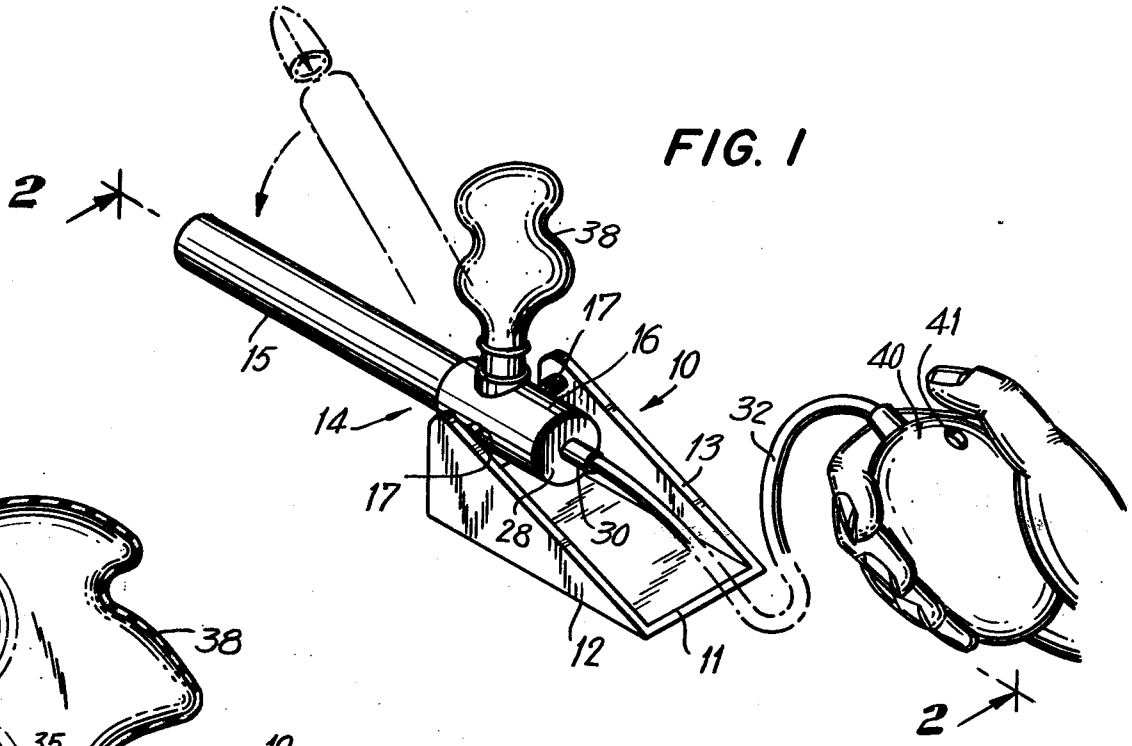
FIG. 1 is a perspective view of a cannon device of the type described.

Turning now to the drawings, there is shown in FIG. 1 a projectile launching device 10 which includes a horizontal base 11 and vertically directed side flanges 12, 13. The apparatus includes a housing assembly 14 including a barrel 15 and a launching mechanism 16. Optionally but preferably, the base 11 and housing assembly 14 may be fabricated of rigid plastic material.

The housing assembly 14 is pivotally connected to the barrel by a pair of opposed, coaxially aligned trunnions 17 extending integrally from the walls 18 of the housing. The trunnions fit into inwardly directed sockets 19, 20 extending from the flanges 13 and 12, respectively, of the base. The interfit of the trunnions and sockets is such as to provide a frictional resistance to turning, whereby the housing can be rotated relative to the base in a vertical plane responsive to manual pressure but will remain or be retained at its selected angularly oriented position.

The barrel 15 is hollow and includes an internal cylindrical bore 21 for guiding projectile 22, which is slidingly received within the barrel. The projectile 22 may be comprised of a light weight and rigid plastic material and is preferably hollowed, as shown at 23.

The housing assembly 14 includes a cylindrical bore 24 defining a chamber for movement of a pilot valve member 25. A wall 26 separates the bore 24 from the barrel 15. A discharge aperture 27 is formed in the wall 26.

The bore of chamber 24 includes a rear wall portion 28 thereof a pressure feed port 29. The feed portion 29 is surrounded by an annular flange 30, within which flange is mounted one end 31 of a flexible hollow conduit 32.

A reservoir port 33 is formed in the bore 24 adjacent the wall 26 of the housing, the reservoir port being of larger diameter than the pressure feed port 29. A rigid cylindrical nipple 34 extends outwardly from the port 33, the nipple including at its outermost end 35 an annular lip 36 forming an anchorage area for mouth 37 of a storage reservoir balloon 38 for receiving air under pressure. The balloon 38 is formed of expansible elastomeric material, e.g. rubber.

The conduit 32 is connected at the end 39 remote from the cannon device to a pump assembly 40. Preferably, the pump assembly 40 is comprised of an elastomeric bulb member of the type typically used on blood pressure measuring devices or the like, a bulb having a volumetric capacity sufficient to hold about 3 ounces of water being satisfactory.

The pump member 40 includes an aperture 41 leading to the interior thereof. The bulb is of the type which is self-restoring when released and, as known, functions to expel air into the end 39 of the conduit when the same is compressed to reduce the internal volume thereof. G. 3), the gasket or sealing end 42 is pressed against and seals the discharge aperture 27 formed in wall 26, isolating the barrel from the interior of the bore or chamber 24.

The pilot 25 includes a rearwardly extending, enlarged diameter portion 44 which fits relatively snugly within the bore 24 but nonetheless permits the passage of air through a restricted clearance space 45. The clearance space 45 may be defined either by the reduced diameter of the pilot relative to the bore or by one or more small axially directed grooves on the upper periphery of the enlarged diameter portion 44 of the pilot.

A forwardly facing annular shoulder 48 defining a reactive piston surface portion is formed on the pilot at the junction of the reduced and enlarged diameter portions 43 and 44, respectively.

It will be appreciated from the foregoing description that the enlarged diameter portion 44 effectively divides the pump 24 into two chambers, namely, a chamber 46 rearwardly of the pilot and a chamber 47 forwardly of the pilot. It is further evident that a restricted leakage path is defined in the area 45 between the noted chambers.

The operation of the device will now be described.

Figure 2:
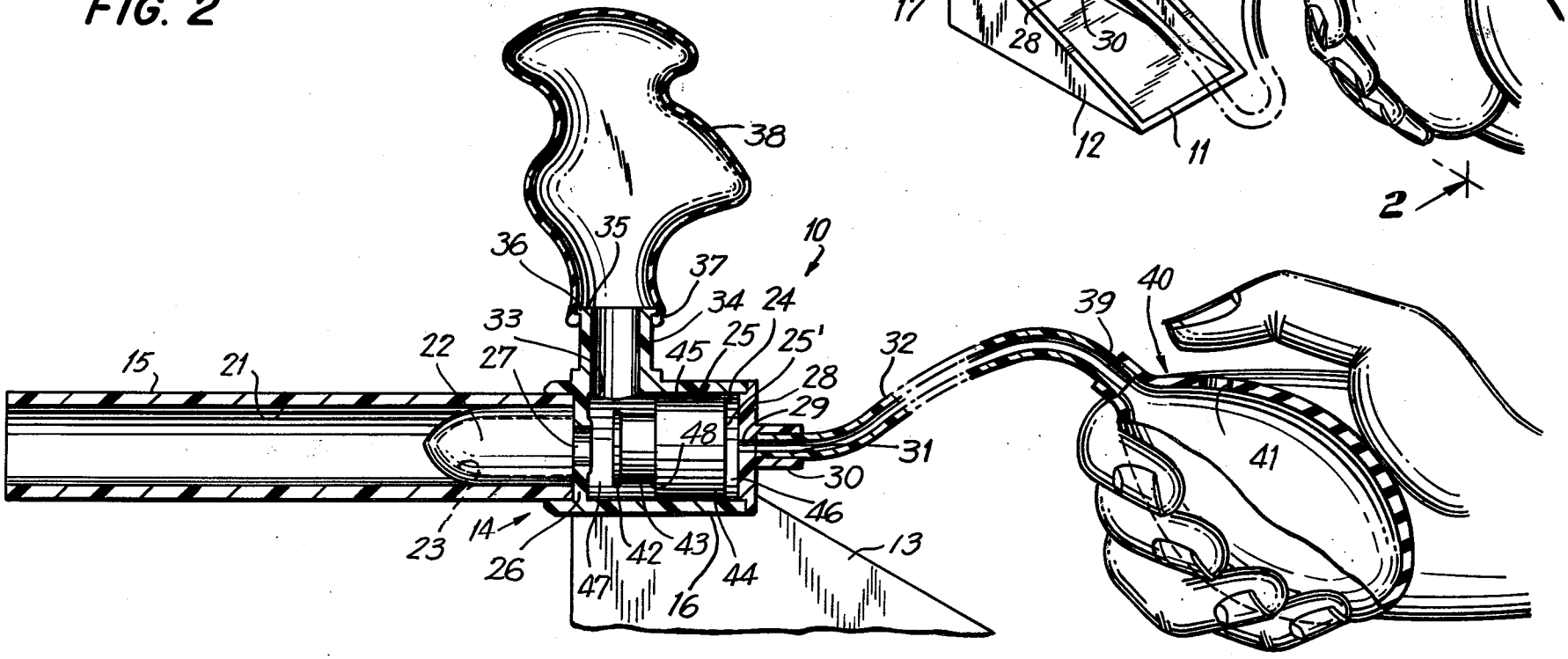
FIG. 2 is a magnified vertical section taken on the line 2—2 of FIG. 1 showing the position of the parts after firing cycle has been completed and a fresh projectile loaded.
Figure 3:
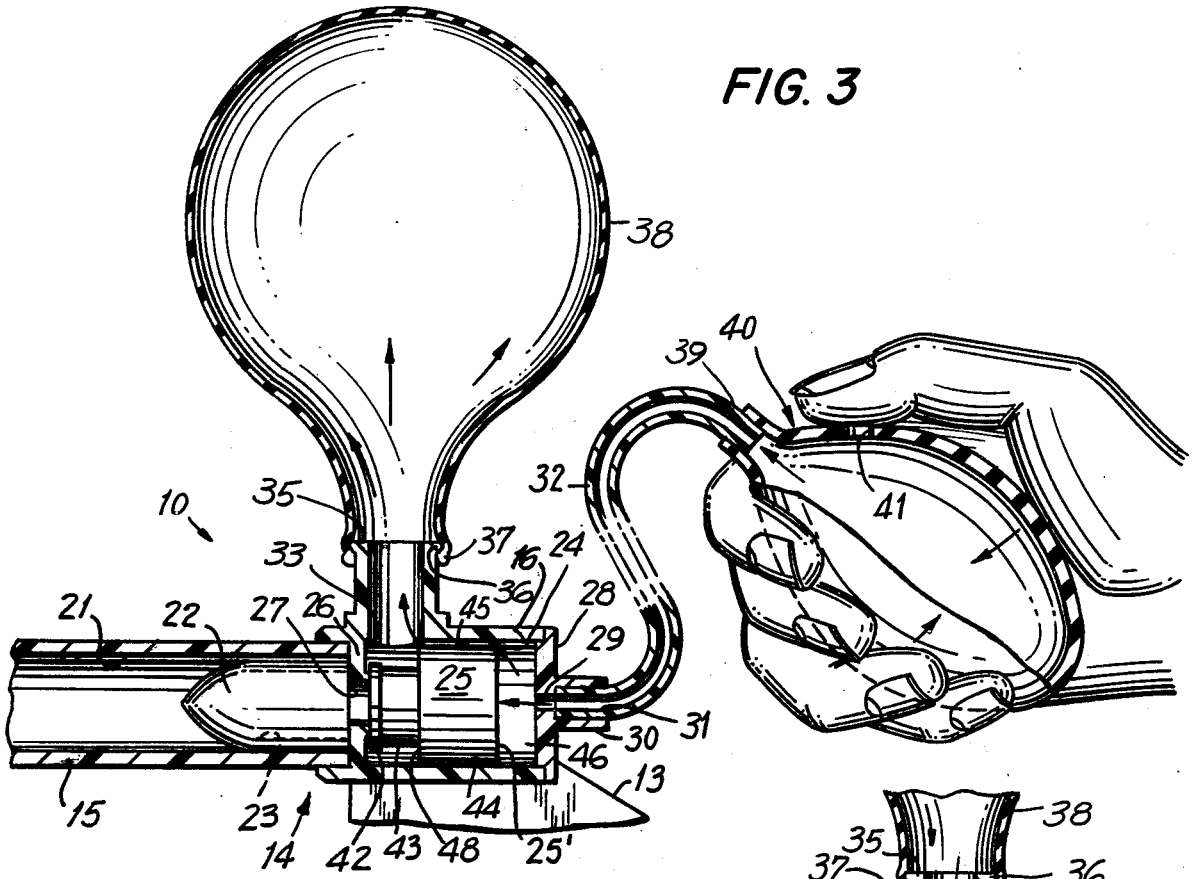
FIG. 3 is a fragmentary view similar to FIG. 2 showing the position of the parts with the pneumatic reservoir charged.

A projectile 22 is loaded into the barrel in such manner that the rear end thereof lies against the wall 26 dividing the barrel from the chamber 47. The parts are now in the position represented by cross section FIG. 2. The device is charged by compressing the pump 40 with the thumb sealing the aperture 41 of the bulb. Compression of the pump forces air through the conduit 32, shifting the pilot 25 leftwardly by reaction against the piston face 25′ at the rear end of the pilot 25, sealing the aperture 27 separating the chamber 47 from the barrel (see FIG. 3). With continued compression of the bulb, air is forced into the now sealed chamber 46, around the upper portion of the pilot 25, through the reservoir port 33, and into the balloon 38 (see arrows, FIG. 3). Compression of the pump results in a partial inflation of the balloon, the fully expanded but unstressed volume of which should preferably be somewhat less than that of the bulb. The partially inflated balloon defines an energy storage reservoir by virtue of the distension of the elastomeric walls of the balloon.

Figure 4:
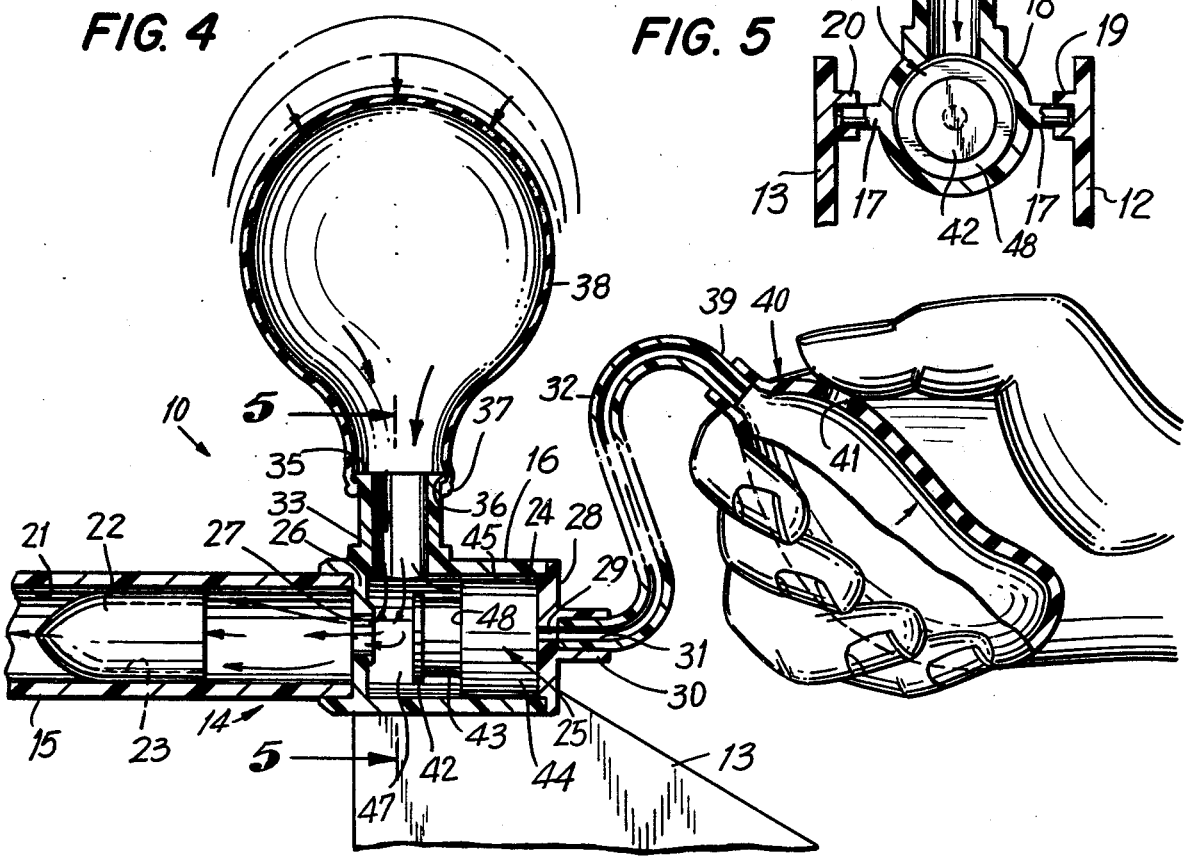
FIG. 4 is a view similar to FIG. 3 showing the position of the parts in the initial stages of a launch.
Figure 5:
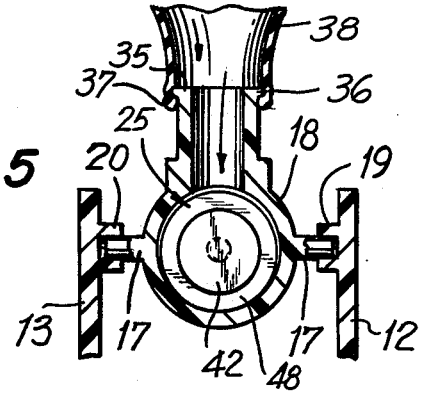
FIG. 5 is a vertical section taken on the line 5—5 of FIG. 4.

When the bulb is released, the chamber 46 is coupled to the atmosphere and the pressure in the chamber 47 forwardly of the pilot is thus greater than the pressure in the chamber 46. By virtue of this pressure differential acting against the forwardly facing shoulder 48 or piston face of the pilot, the pilot is shifted rapidly to the right from the position shown in FIG. 3 to that of FIG. 4, releasing the stored energy in the balloon to flow outwardly through the port 33 into the chamber 47 and through the now open discharge aperture 27. The swiftness of movement of the pilot from the position of FIG. 3 to that of FIG. 4 is increased if the aperture 41 of the bulb 40 is covered while the bulb is permitted to expand, resulting in creation of a sub-atmospheric pressure in the conduit 32.

The sudden energy release is effective to launch a light weight plastic projectile a distance of about 8 to 10 feet. The more rapid the pilot movement, the more efficiently the energy stored will be transmitted to the projectile.

Since the release of the projectile is triggered entirely through changes of pneumatic pressure within the conduit 32, the jerking or jarring typically associated with activation of a mechanically attached trigger is entirely eliminated. The projectile is thus launched with great accuracy.

It will be recognized that the device may be inexpensively manufactured principally of plastic components.

Various modifications may occur to those skilled in the art who have been apprised of the instant disclosure and, accordingly, the invention is to be broadly construed within the scope of the appended claims.

Having thus described the invention and illustrated its use, what is claimed as new and is desired to be secured by Letters Patent is:

1. A toy pneumatic projectile launching device comprising a housing having a bore, barrel means connected to said housing for receiving and guiding a projectile to be launched, an air pressure storage reservoir connected to said bore adjacent said barrel means, a flow passage extending between said barrel means and said bore, a pilot member movably mounted in said bore for selectively closing and opening said flow passage between said barrel and reservoir, and pump means operatively connected to said bore for charging said reservoir and maintaining said pilot in said closing position responsive to super-atmospheric pressure generated by said pump means and for shifting said pilot member from said closing to said opening position of said passage responsive to pressures in said pump means below the pressure in said reservoir.

2. Apparatus in accordance with claim 1 wherein said pilot member includes an enlarged diameter portion dividing said bore into first and second chambers respectively in communication with said reservoir and said pump means, said pilot being shifted to said closing position when the pressure in said pump means exceeds the pressure in said reservoir, and to said opening position when the pressure in said reservoir exceeds the pressure in said pump means.

3. Apparatus in accordance with claim 2 wherein said pilot, in said closing position, provides a limited flow path between said pump means and said reservoir.

4. Apparatus in accordance with claim 2 wherein said pump means comprises an elastomeric self-restoring bulb member having an orifice selectively communicable with the atmosphere whereby super-atmospheric pressure is developed when said bulb member is compressed with said orifice sealed to the atmosphere, atmospheric pressure is developed when said orifice is opened to the atmosphere, and sub-atmospheric pressure is developed when said bulb member is expanded with said orifice sealed to the atmosphere.

5. Apparatus in accordance with claim 4 wherein said reservoir comprises an elastically expansible chamber.

6. Apparatus in accordance with claim 1 wherein said reservoir comprises a resiliently distendable elastomeric chamber.

7. Apparatus in accordance with claim 6 and including a flexible conduit interposed between said pump means and said bore.

* * * * *